US009142373B2

(12) United States Patent
Masui et al.

(10) Patent No.: US 9,142,373 B2
(45) Date of Patent: Sep. 22, 2015

(54) ELECTROMAGNETIC RELAY

(71) Applicant: OMRON Corporation, Kyoto-shi, Kyoto (JP)

(72) Inventors: Yasuyuki Masui, Kumamoto (JP); Toshiyuki Kakimoto, Shiga (JP); Tsukasa Yamashita, Kumamoto (JP); Keisuke Yano, Kumamoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/164,583

(22) Filed: Jan. 27, 2014

(65) Prior Publication Data

US 2014/0225689 A1 Aug. 14, 2014

(30) Foreign Application Priority Data

Feb. 13, 2013 (JP) ..... 2013-025687

(51) Int. Cl.
*H01H 50/56* (2006.01)
*H01H 50/58* (2006.01)
*H01H 50/64* (2006.01)

(52) U.S. Cl.
CPC ..... *H01H 50/56* (2013.01); *H01H 50/58* (2013.01); *H01H 50/642* (2013.01); *H01H 50/646* (2013.01)

(58) Field of Classification Search
CPC ..... H01H 50/56; H01H 50/58; H01H 50/646
USPC ..... 335/78–86
See application file for complete search history.

(56) References Cited

U.S. PATENT DOCUMENTS

| | | | | |
|---|---|---|---|---|
| 2,833,885 | A | 5/1958 | Wells et al. | |
| 6,246,306 | B1 | 6/2001 | Gruner | |
| 7,710,224 | B2 | 5/2010 | Gruner et al. | |
| 2014/0015628 | A1 * | 1/2014 | Shinkai et al. | 335/189 |

FOREIGN PATENT DOCUMENTS

| | | | |
|---|---|---|---|
| EP | 0237610 | A2 | 9/1987 |
| EP | 2187420 | A2 | 5/2010 |
| JP | 2005-166431 | A | 6/2005 |
| JP | 2012-190763 | A | 10/2012 |
| WO | WO2012124165 | A1 * | 9/2012 |

OTHER PUBLICATIONS

Extended European Search Report in counterpart European Patent Application No. 14151041.2, mailed May 21, 2014 (7 pages).
Notification of Reasons for Refusal issued in corresponding Korean Application No. 10-2014-0002701, mailed on Dec. 24, 2014 (11 pages).

* cited by examiner

*Primary Examiner* — Ramon Barrera
(74) *Attorney, Agent, or Firm* — Osha Liang LLP

(57) ABSTRACT

An electromagnetic relay has a fixed touch piece having a fixed contact, a movable touch piece having a movable contact contactably and separably opposed to the fixed contact, and configured to elastically deform, an auxiliary member configured to energize the movable touch piece to the fixed contact piece side, an electromagnet, and an intermediate member configured to be operated by magnetization of the electromagnet and elastically deform the movable touch piece.

6 Claims, 16 Drawing Sheets

ELECTROMAGNETIC RELAY

BACKGROUND OF THE INVENTION

1. Technical Field

The present invention relates to an electromagnetic relay.

2. Related Art

As a conventional electromagnetic relay, for example, one is known in which three plate springs are superimposed and integrated by fastening and fixing the one end side at three protrusions while fastening and fixing the other end side with a contact, so as to constitute a spring assembly (movable touch piece) (e.g., see U.S. Pat. No. 7,710,224).

However, in the above conventional electromagnetic relay, since the movable touch piece is made up of the three plate springs and those are integrated, in the case of elastically deforming them, it is necessary to act force against elastic force of the three plates. Hence it is necessary to increase driving force generated by a coil assembly (electromagnet) which is used for elastically deforming the movable touch piece. This may result in having to increase the size of the electromagnet or increase a current supply amount.

SUMMARY

One or more embodiments of the present invention smoothly drives a movable touch piece with saved power consumption even when one with a large elastic modulus is used as the movable touch piece.

An electromagnetic relay according to one or more embodiments of the present invention includes: a fixed touch piece having a fixed contact; a movable touch piece, having a movable contact contactably and separably opposed to the fixed contact, and configured to elastically deform; an auxiliary member configured to energize the movable touch piece to the fixed contact piece side; an electromagnet; and an intermediate member configured to be operated by magnetization of the electromagnet and elastically deform the movable touch piece.

Here, the intermediate member refers to a member that serves to transmit driving force, which is generated in association with magnetization and demagnetization of the electromagnet, to the movable touch piece. For example, the intermediate member includes a movable iron piece, a card member and the like.

With the above configuration, since the movable touch piece is energized to the fixed touch piece side by the auxiliary member, it is possible to smoothly elastically deform the movable touch piece even at an initial stage when large suction force cannot be acted on the intermediate member by energizing the electromagnet. Therefore, even when one with a large elastic modulus is used as the movable touch piece, it is not necessary to increase the size of the electromagnet or increase power consumption. Further, even when impact force acts on the electromagnetic relay, since the auxiliary member is energizing the movable touch piece, it is excellent in impact resistance and does not give rise to a defect such as deformation of the movable touch piece.

According to one or more embodiments of the present invention, the auxiliary member energizes the movable touch piece from the surface on the opposite side to the fixed touch piece.

According to one or more embodiments of the present invention, the auxiliary member is configured so as to energize the movable touch piece to the fixed touch piece side up to a predetermined position before closing of the contacts.

With this configuration, since energization force generated by the auxiliary member does not act on the movable touch piece in the case of demagnetizing the electromagnet, it is possible to smoothly open the contacts by elastic force of the movable touch piece itself. This can result in giving an electromagnetic relay with good operating characteristics.

According to one or more embodiments of the present invention, the auxiliary member is configured so as to no longer energize the movable touch piece after closing of the contacts.

With this configuration, even when the energization force generated by the auxiliary member is released after closing of the contacts, it is possible to act suction force generated by the electromagnet on the movable touch piece. Further, it is possible to prevent contact pressure from becoming higher than necessary.

According to one or more embodiments of the present invention, the auxiliary member comes into surface-contact from a terminal portion of the movable touch piece to a vicinity of the movable contact.

With this configuration, namely a configuration where the movable touch piece and the auxiliary member are brought into surface-contact with each other, it is possible to increase a sectional area, so as to increase a current capacity. In this case, since the auxiliary member is not fixed to the movable touch piece, it just follows elastic deformation of the movable touch piece. Therefore, even when the movable touch piece is repeatedly driven, stress is not concentrated as in the case of it being fixed. That is, the repetition elasticity life of the movable touch piece can be set to a desired value.

According to one or more embodiments of the present invention, due to provision of the auxiliary member for energizing the movable touch piece to the contacts-closed side, it is possible to smoothly elastically deform the movable touch piece without increasing the size of the electromagnet or increasing a current supply amount even when the movable touch piece is one having a large elastic modulus. Further, even when impact force acts, since the movable touch piece is energized by the auxiliary member, it is excellent in impact resistance and does not give rise to a defect such as deformation.

DETAILED DESCRIPTION

Hereinafter, embodiments of to the present invention will be described in accordance with accompanying drawing. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. It is to be noted that in the following description, although terms indicating a specific direction or position (e.g., terms including "upper", "lower", "side" or "end") will be used according to the need, the purpose of using these terms is to facilitate understanding of the invention with reference to the drawings, and the meanings of these terms are not intended to restrict the technical scope of the present invention. Further, the following descriptions are merely illustrative, and are not intended to restrict the present invention, applications thereof or the use thereof.

Figure 1:
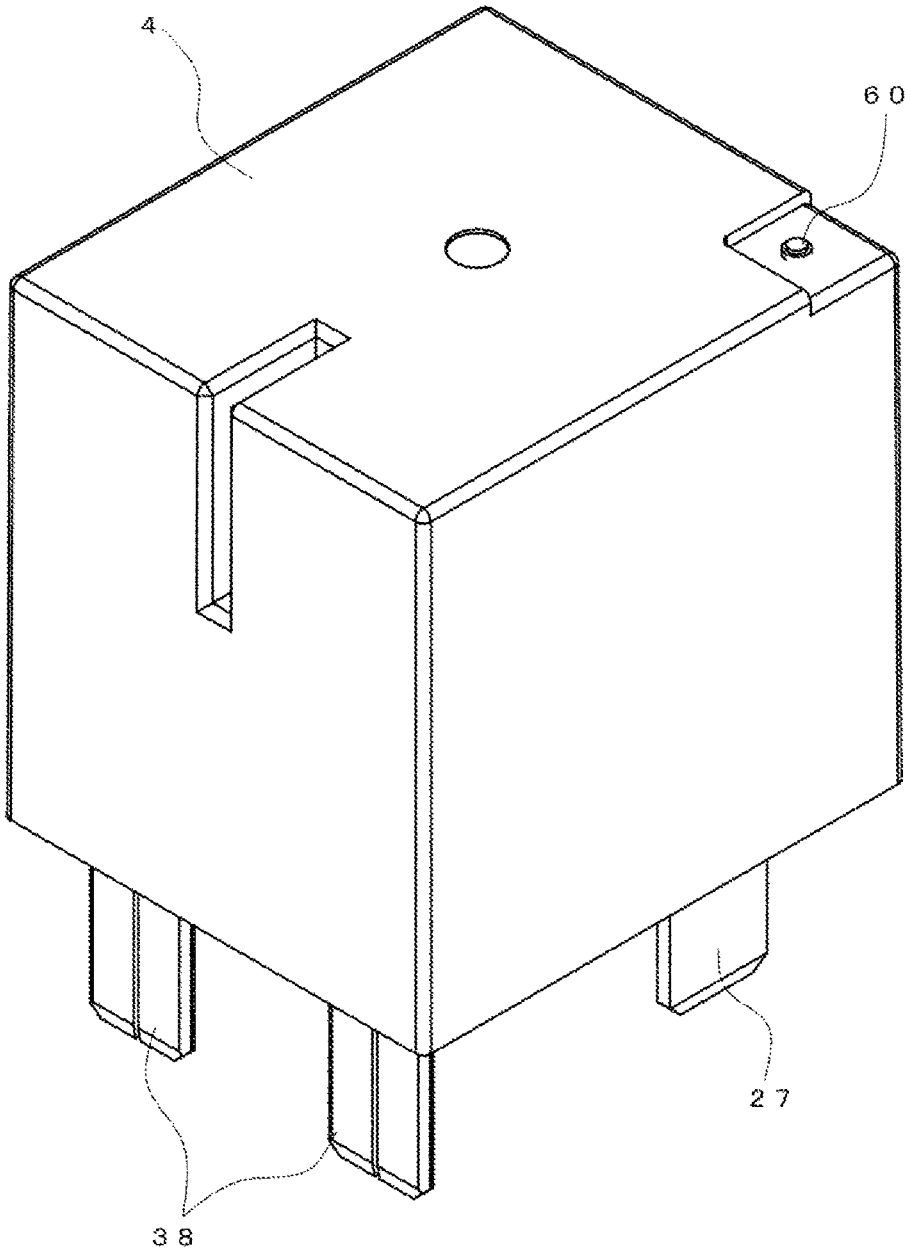
FIG. 1 is a perspective view of an electromagnetic relay according to one or more embodiments of the present invention.
Figure 2:
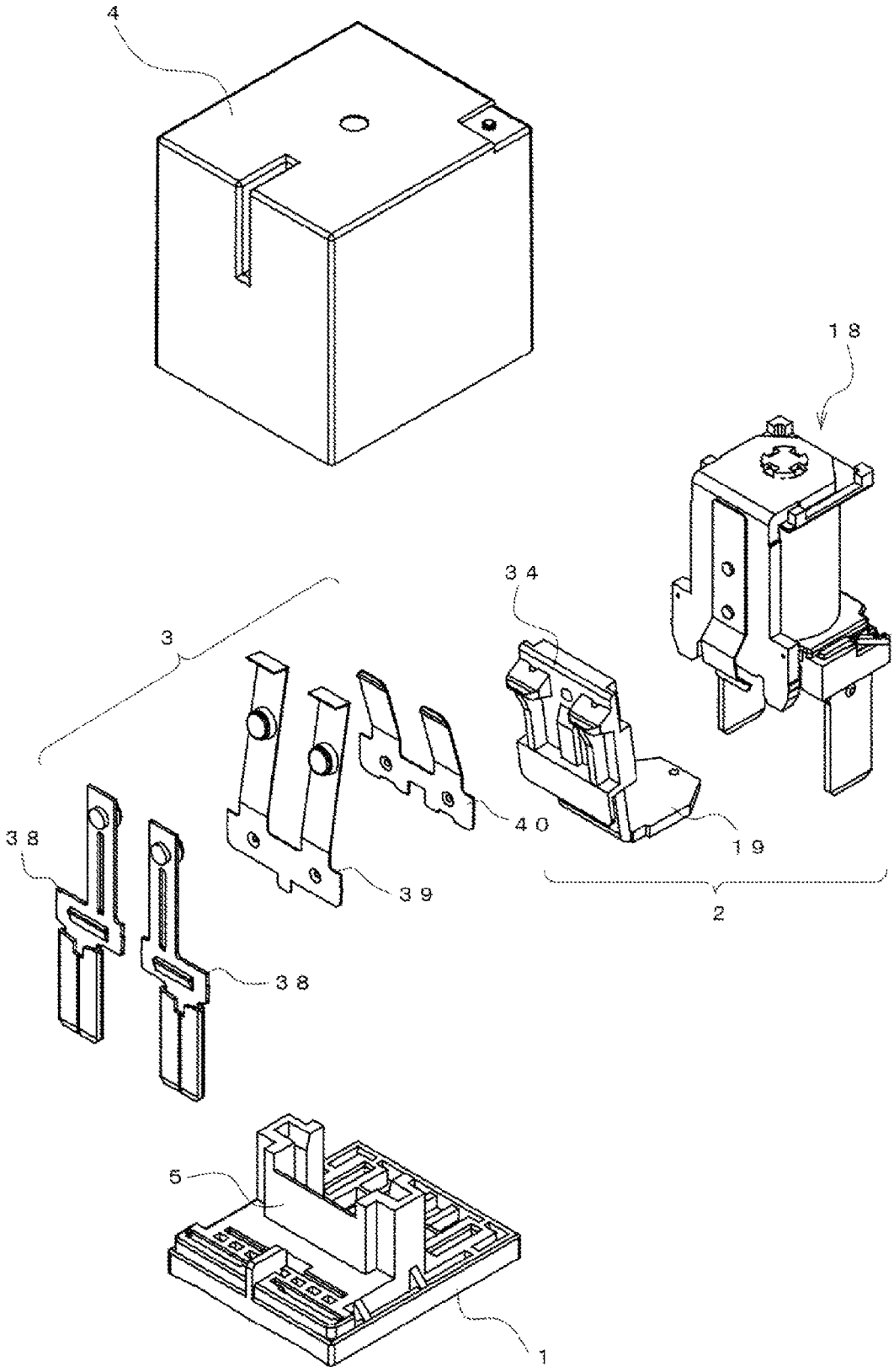
FIG. 2 is an exploded perspective view of FIG. 1.

FIG. 1 is a perspective view showing an appearance of an electromagnetic relay according to one or more embodiments of the present invention, and FIG. 2 is an exploded perspective view thereof. This electromagnetic relay is schematically made up of a base 1, an electromagnet portion 2, a contact switch portion 3, and a casing 4.

Figure 3:
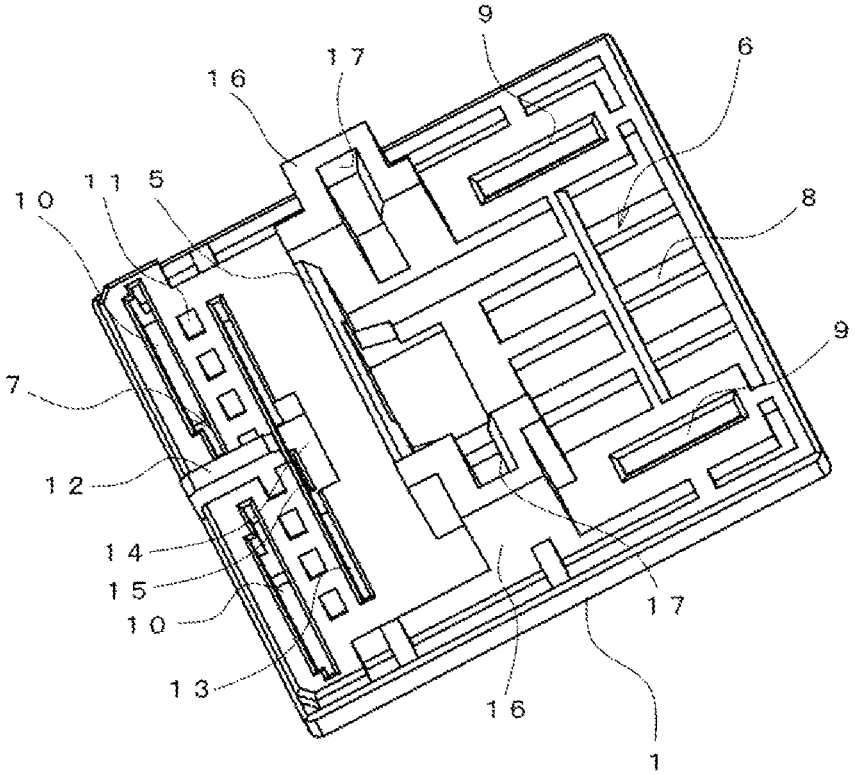
FIG. 3 is a perspective view of a base of FIG. 2.

As shown in FIG. 2, and specifically shown in FIG. 3, the base 1 is one formed by molding a synthetic resin material into a plate shape. A central portion on the upper surface of the base 1 is provided with a partition wall 5, to divide the base 1 into two portions: a first mounting portion 6 to be arranged with the electromagnet portion 2; and a second mounting portion 7 to be arranged with the contact switch portion 3.

A central part on the upper surface of the first mounting portion 6 is formed with a lattice-like rib 8 by a plurality of recessed portions having a rectangular shape in a plan view. Further, each side of the first mounting portion 6 is formed with a coil terminal hole 9 having a rectangular shape in a plan view and penetrating between the upper and lower surfaces.

The second mounting portion 7 is formed with fixed terminal holes 10 penetrating between the upper and lower surfaces respectively in two places in a width direction along one end surface. Further, a plurality of recessed portions 11 are formed along the fixed terminal holes 10. The fixed terminal holes 10 and the recessed portions 11 are separated by an auxiliary wall 12 at the center. Further, a fitting recessed portion 13 extending in the width direction is formed adjacent to the plurality of recessed portions 11. The fitting recessed portion 13 has in the central portion thereof an escape recessed portion 14 extending to the other end side. A central portion on the bottom surface of the escape recessed portion 14 is formed with an aligning hole 15 penetrating to the lower surface.

Each side of the partition wall 5 is formed with a guide portion 16 protruding more than this partition wall 5. Each guide portion 16 is formed with a guide groove 17 extending to the opposed surface in a vertical direction.

The electromagnet portion 2 is made up of an electromagnet 18 and a movable iron piece 19 driven by this electromagnet 18.

Figure 4:
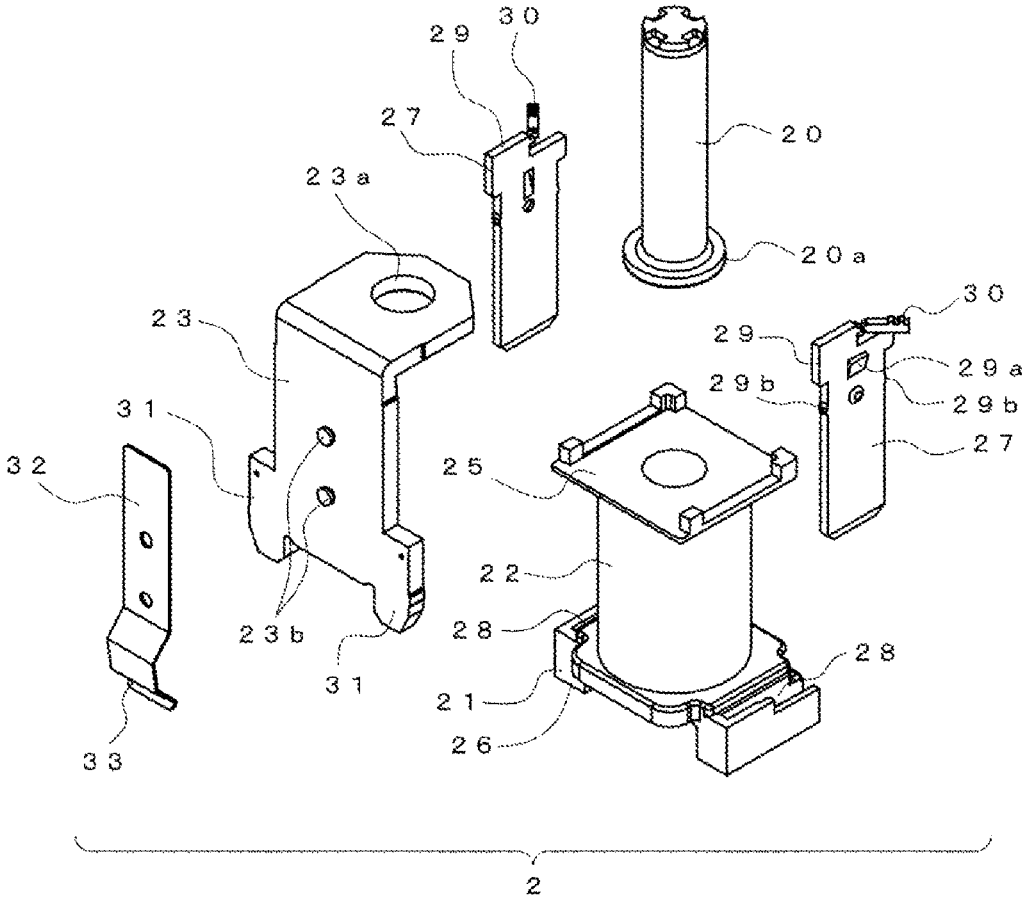
FIG. 4 is an exploded perspective view of an electromagnet of FIG. 2.

As shown in FIG. 4, the electromagnet 18 is one obtained by winding a coil 22 around an iron core 20 via a spool 21.

The iron core 20 is one formed of a magnetic material into a cylindrical shape. The lower end of the iron core 20 is formed with a guard portion 20*a*, and the lower surface thereof is a suction surface. A yoke 23 is fastened and fixed to the upper end of the iron core 20.

Figure 8:
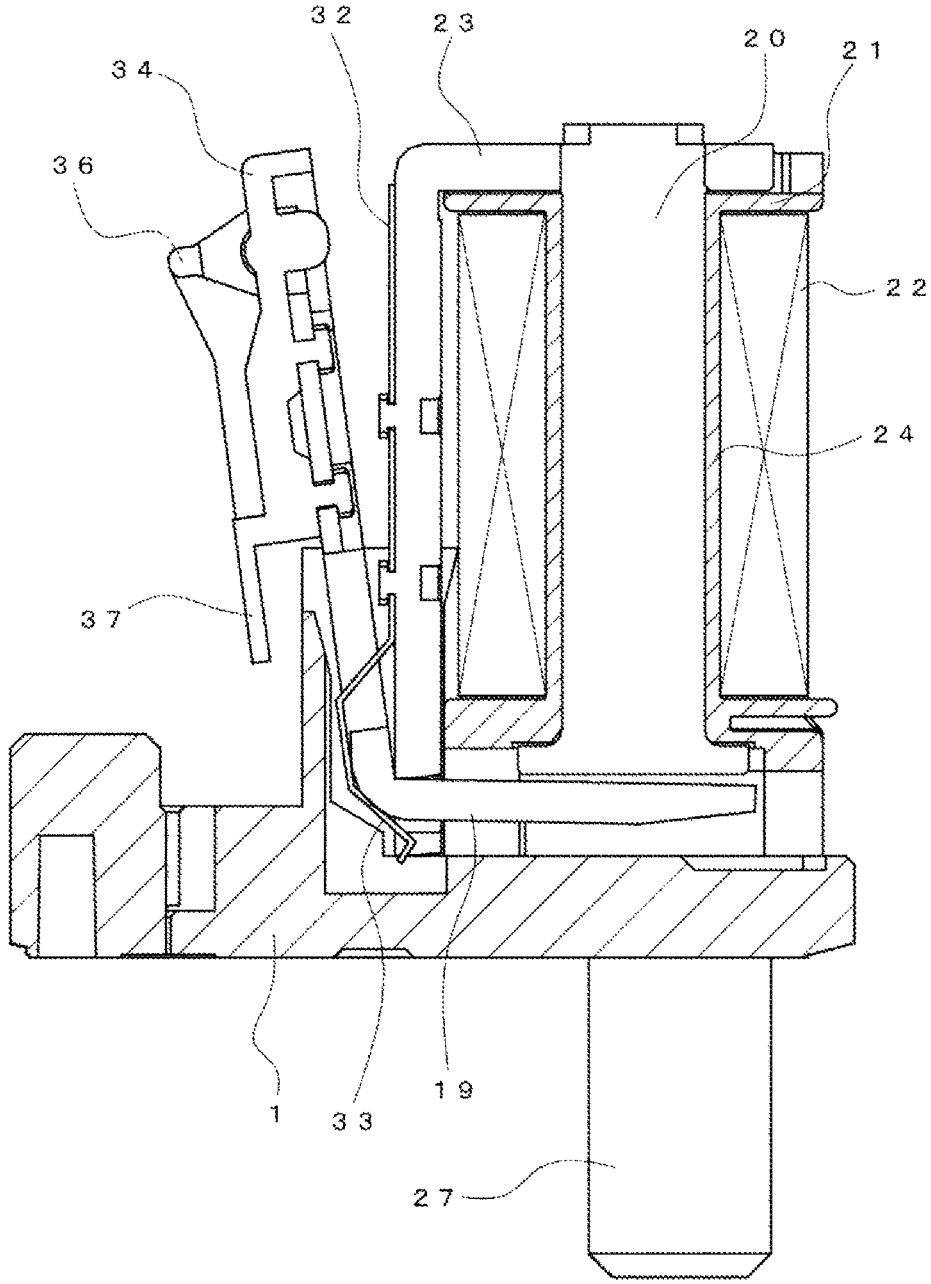
FIG. 8 is a front sectional view of the electromagnetic relay shown in FIG. 1 in a state where a casing and a contact switch portion have been removed.

The spool 21 is one obtained by molding a synthetic resin material into a substantially cylindrical shape. The coil 22 is wound around a body 24 (cf. FIG. 8) of the spool 21. Each end of the spool 21 is formed with a guard portion. The upper surface of an upper-end-side guard portion 25 is formed with a groove portion where a horizontal portion of the yoke 23 is to be arranged. Each side of a lower-side guard portion 26 is formed with a coil press-fitting hole 28 where a coil terminal 27 is to be press-fitted.

The coil terminal 27 is made of a metallic plate member having conductivity, and the upper end part thereof is formed with a wide portion 29. Part of the wide portion 29 is cut and raised, to become a winding portion 30 where a leader line of the coil 22 is to be wound. The central part on the side surface of the wide portion 29 is formed with a protrusion 29*a*. Further, each side portion of the coil terminal 27 is formed with a protrusion 29*b* protruding to the lateral side in the vicinity of the wide portion 29. At the time of inserting the coil terminal 27 into the coil press-fitting hole 28 formed in the lower-side guard portion 26 of the spool 21, these protrusions 29*a*, 29*b* come into a press-fitted state, to align the coil terminal 27 with respect to the spool 21.

The yoke 23 is one formed by bending a plate member made of a magnetic material is bent into a substantially L-shape. A central part of a horizontal portion thereof is formed with a through hole 23*a*. The upper end of the iron core 20 is inserted into the through hole 23*a* and fastened. In this fastened state, the horizontal portion of the yoke 23 extends to the lower end side along the coil 22 wound around the spool 21. Each side of the lower end of a vertical portion of the yoke 23 is a press-fitting portion 31 protruding to the lateral side and to the lower side. The press-fitting portion 31 is press-fitted into the guide groove 17 formed in the guide portion 16 of the base 1, to align the yoke 23, namely the electromagnet 18, with respect to the base 1. Further, fastening protrusions 23*b* are formed in two (upper and lower) places on the outer surface of the vertical portion. A hinge spring 32 is fastened and fixed to the yoke 23 through use of these protrusions 23*b*.

A substantially C-shaped flexing portion 33 is formed on the lower end side of the hinge spring 32. This flexing portion 33 elastically supports the movable iron piece 19 between itself and the lower end of the yoke 23. This can make the movable iron piece 19 rotatable around the lower end (specifically a left-side corner in FIG. 8) of the yoke 23.

Figure 5A:
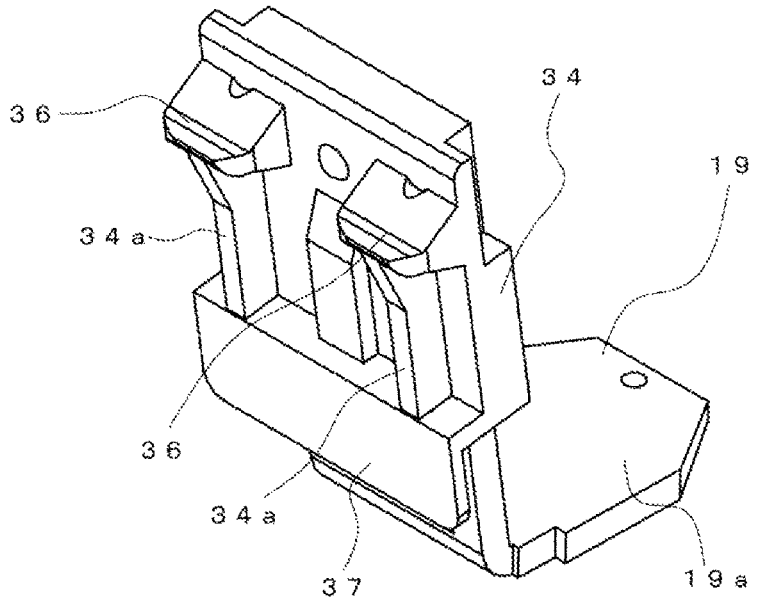
FIG. 5A is an enlarged perspective view of a movable iron piece and a card member of FIG. 2.
Figure 5B:
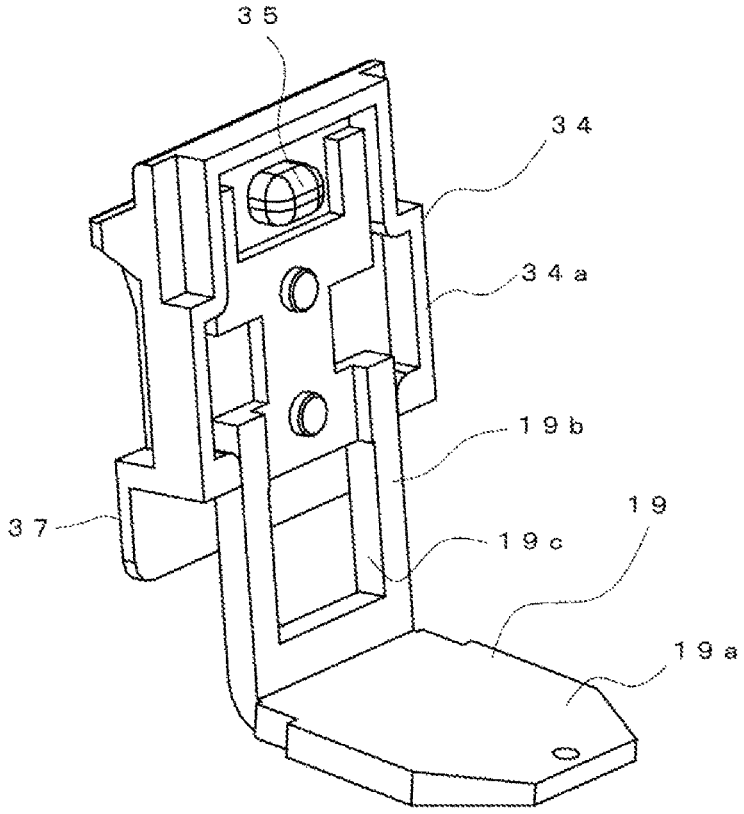
FIG. 5B is a perspective view showing a state of FIG. 5A as seen from a different angle.

As shown in FIG. 5, the movable iron piece 19 is made of a plate member of a magnetic material, and flexed in an intermediate part, to have a substantially L-shape. A horizontal portion 19*a* obtained by the flexing is sucked to the suction surface of the iron core 20. A vertical portion 19*b* is formed with a rectangular hole 19*c*, though which the flexing portion 33 of the hinge spring 32 is to be inserted. Further, the vertical portion 19*b* is formed with through holes (not shown) for integration with a card member 34 in two places in the above part of the rectangular hole 19*c*.

The movable iron piece 19 is integrated with the card member 34 by insertion molding (or may be integrated not by insertion molding but by thermal fastening or the like). The card member 34 is one formed of a synthetic resin material into the plate shape. The rear surface thereof comes into contact with the vertical portion 19*b* of the movable iron piece 19, and projected threads 34*a* are formed on peripheral three sides so as to surround this vertical portion 19*b*. Further, the rear surface of the card member 34 is formed with a protrusion portion 35 protruding to the rear surface side via a notch formed in the upper part of the vertical portion of the movable iron piece 19. This protrusion portion 35 comes into contact with the hinge spring 32 fastened and fixed to the yoke 23, to restrict the range of rotation in this direction. On the other hand, the front surface of the card member 34 is formed with the projected threads 34*a* vertically extending on two rows in the width direction, and the upper end part of each projected thread 34*a* is formed with a pressing portion 36 protruding to the front surface side. The lower end of the card member 34 is formed with a guide piece portion 37 protruding forward and then flexed downward. The guide piece portion 37 is arranged on the second mounting portion 7 side over the partition wall 5 of the base 1.

The contact switch portion 3 is made up of a fixed touch piece 38, a movable touch piece 39 and an auxiliary member 40.

Figure 6:
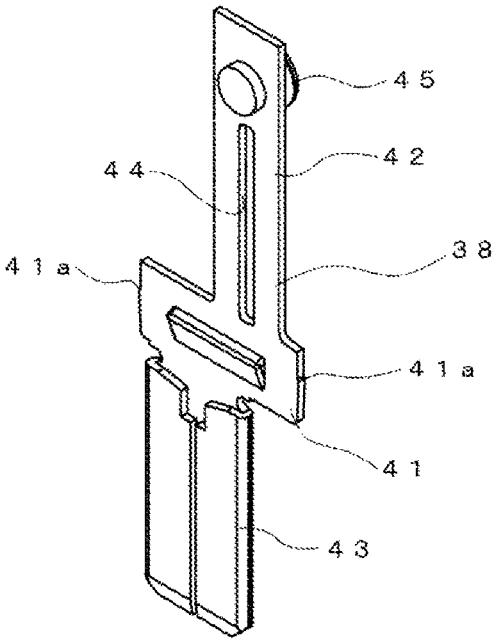
FIG. 6 is an enlarged perspective view of a fixed touch piece of FIG. 2.

As shown in FIG. 6, the fixed touch piece 38 is one formed of a metallic material having conductivity into the plate shape. The fixed touch piece 38 is made up of a press-fitting portion 41 to be press-fitted into the fixed terminal hole 10 formed in the base 1, a touch piece portion 42 extending upward from the press-fitting portion 41, and a terminal portion 43 extending to the lower side from the press-fitting portion 41. One surface of the press-fitting portion 41 is formed with a protrusion portion 41*a* extending in the width direction. The touch piece portion 42 is formed with a slit 44 vertically extending in a central position. Further, a fixed contact 45 is fastened and fixed to the upper end of the touch piece portion 42. Moreover, the terminal portion 43 is folded from both sides.

Figure 7:
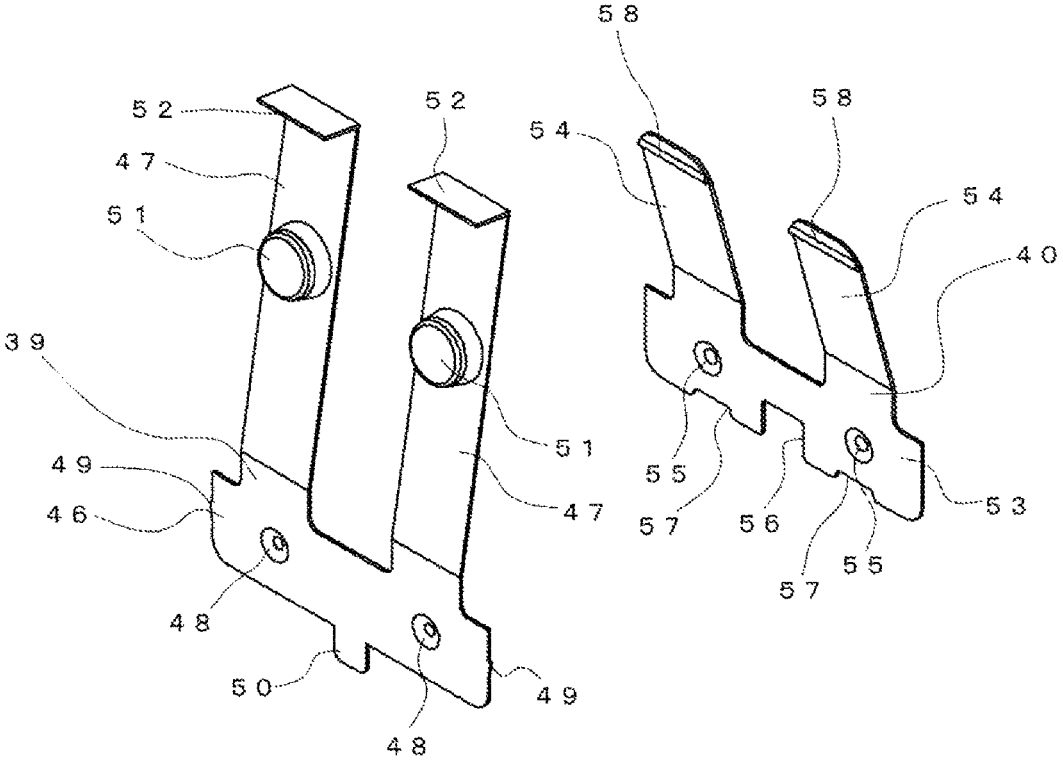
FIG. 7 is an enlarged perspective view of a movable touch piece and an auxiliary member of FIG. 2.

As shown in FIG. 7, the movable touch piece 39 is one formed of a metallic material having conductivity and elasticity into the plate shape. The movable touch piece 39 is made up of a press-fitting portion 46 and a pair of body portions 47 respectively extending from both sides of the press-fitting portion 46 to the upper side. The press-fitting portion 46 is formed with a pair of protrusions 48, which bulge in a plate thickness direction, at a predetermined interval in the width direction (in FIG. 7, only the recessed portion side for forming the protrusions 48 is shown). Each end of the press-fitting portion 46 further extends to the lateral side, and a latching pawl 49 is protruding from the side edge thereof. Further, a central portion at the lower edge of the press-fitting portion 46 is formed with a press-fitting piece 50 further extending downward. Each of the body portions 47 is flexed in the vicinity part of the press-fitting portion 46 and extends, and the upper end of the body portion 47 is formed with a through hole, where a movable contact 51 is fastened and fixed. Further, the upper end of the body portion 47 is formed with an extended portion 52 which is flexed obliquely upward to the fixed touch piece side.

As shown in FIG. 7, the auxiliary member 40 is one formed of a metallic material having conductivity and elasticity into the plate shape, as is the above movable touch piece 39. The auxiliary member 40 is made up of a press-fitting portion 53 and energizing portions 54. In the press-fitting portion 53, in positions corresponding to the pair of protrusions 48 formed in the movable touch piece 39, recessed portions to be superimposed thereon are respectively formed, and protrusions 55 are thereby formed respectively (in FIG. 7, only the recessed portion side for forming the protrusion 55 is shown.). Moreover, the press-fitting portion 53 is further extending from each side to the lateral side. A central portion at the lower edge of the press-fitting portion 53 is formed with a first notch 56, and each side thereof is formed with a second notch 57 having a smaller cutting depth. The first notch 56 corresponds to the position of the press-fitting piece 50 of the movable touch piece 39. The press-fitting portion 53 then comes into surface-contact with the press-fitting portion 46 of the movable touch piece 39. The energizing portion 54 protrudes from each side portion at the upper edge of the press-fitting portion 53, and is then inclined to the movable touch piece side. The upper end part of the energizing portion 54 is formed with a pressing protrusion portion 58 to press the movable touch piece 39. The pressing protrusion portion 58 is made up of a projected thread extending in a width direction of the energizing portion 54.

Figure 9:
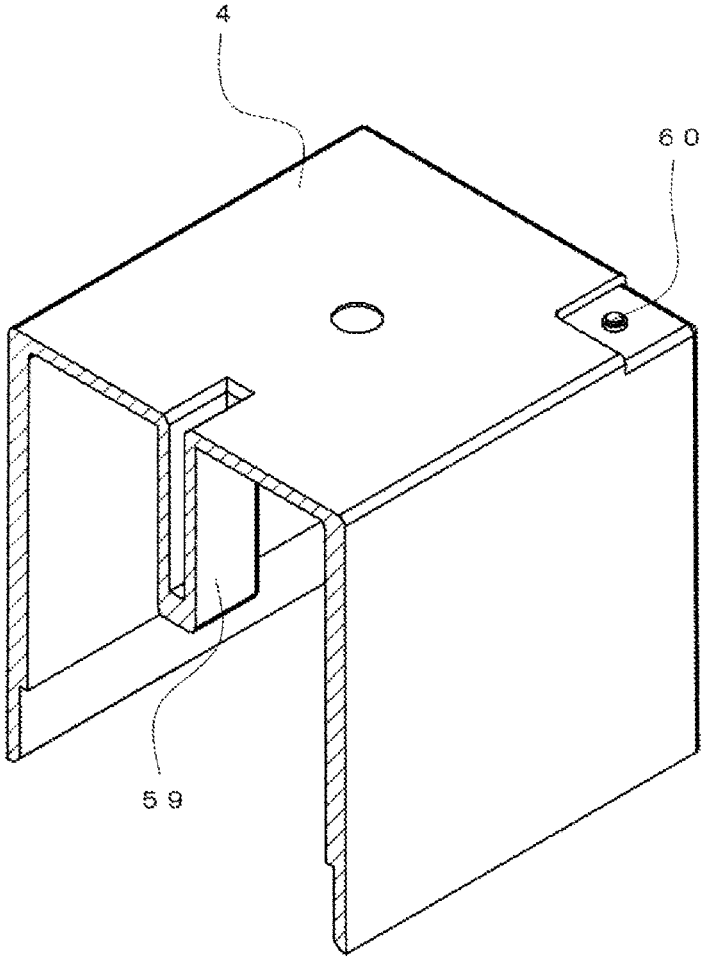
FIG. 9 is a partially ruptured perspective view of the casing shown in FIG. 1.

As shown in FIG. 9, the casing 4 is one obtained by molding a synthetic resin material into the shape of a bottom-open box. The lower-end-side opening of the casing 4 is fitted with the outer side surface of the base 1, thereby to be fixed to the base 1 and cover each component mounted on the base 1. Numeral 59 denotes a separation wall to separate a pair of contact switch parts. Numeral 60 denotes a protrusion which is removed after completion of the electromagnetic relay to form a degassing hole communicating between the inside and the outside. However, this protrusion 60 may not be removed and used as it remains in the sealed state.

Subsequently, an assembly method for the electromagnetic relay with the above configuration will be described.

The coil 22 is wound around the body 24 of the spool 21 and the iron core 20 is inserted through the central hole thereof from the lower side. The coil terminal 27 is press-fitted into the press-fitting hole. In this state, the suction surface of the iron core 20 is exposed on the lower surface of the lower-end-side guard portion of the spool 21. Further, the upper end of the iron core 20 protruding from the upper-end-side guard portion 25 of the spool 21 is inserted into a through hole of the yoke 23, and fastened and fixed. The yoke 23 is previously fastened and fixed with the hinge spring 32. Here, the leader line of the coil 22 is wound around the winding portion 30 of the coil terminal 27 and soldered, and thereafter the winding portion 30 is bent along the wound coil 22. This leads to completion of the electromagnet 18. In the completed electromagnet 18, the movable iron piece 19 is elastically supported between the flexing portion 33 of the hinge spring 32 and the lower end of the yoke 23. The movable iron piece 19 is previously integrated with the card member 34.

The electromagnet 18 assembled with the movable iron piece 19 in such a manner is mounted on the first mounting portion 6 of the base 1. That is, the coil terminal 27 is press-fitted into the coil terminal hole 9 of the base 1, and the press-fitting portion 31 of the yoke 23 is press-fitted into the guide groove 17 formed in the guide portion 16.

The second mounting portion 7 of the base 1 is mounted with the contact switch portion 3. That is, the terminal portion 43 of the fixed touch piece 38 is press-fitted into the fixed terminal hole 10 from the upper surface side of the base 1, and this terminal portion 43 is protruded from the lower surface of the base 1. Further, the movable touch piece 39 and the auxiliary member 40 are superimposed on each other in the press-fitting portions 46, 53, and press-fitted into the fitting recessed portion 13. At this time, since the protrusion 48 on the movable touch piece 39 side is engaged with the recessed portion for forming the protrusion 55 on the auxiliary member 40 side in the press-fitting portions, they can be smoothly press-fitted into the fitting recessed portion 13 without displacement. The engaged part then exerts a press-contact function to come into press-contact with the inner wall of the fitting recessed portion 13.

In the contact switch portion 3 mounted on the base 1 in such a manner, the movable touch piece 39 separates the movable contact 51 from the fixed contact 45 by elastic force of its own. Then, the upper side of the body portion 47 of the movable touch piece 39 rotates the movable iron piece 19 integrated with the card member 34 via the pressing portion 36 of this card member 34. In this state, energization force generated by the energizing portion 54 of the auxiliary member 40 acts so as to cancel part of energization force generated by the body portion 47 of the movable touch piece 39.

Finally, the base 1 is covered with the casing 4, to complete the electromagnetic relay.

Next, an operation of the electromagnetic relay with the above configuration will be described.

Figure 10:
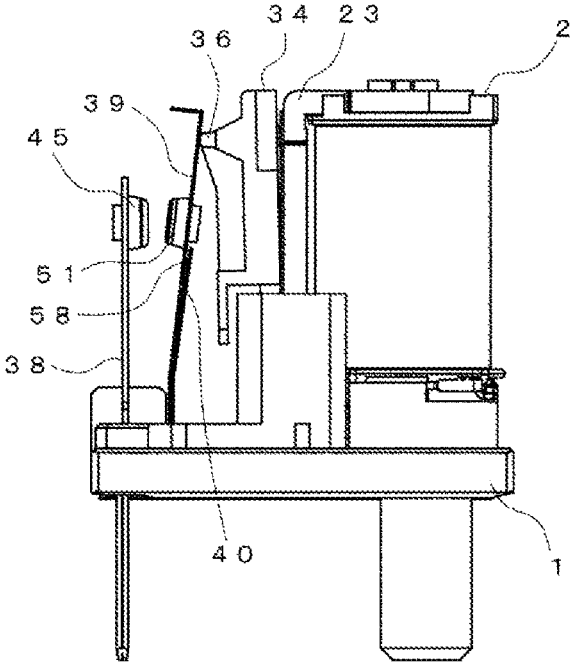
FIG. 10 is a front view of the electromagnetic relay shown in FIG. 1, from which the casing has been removed, with the electromagnet being in a non-magnetized state.

With the electromagnet 18 in the demagnetizing state where a voltage is not applied to the coil 22, as shown in FIG. 10, the movable touch piece 39 is located in a position to separate the movable contact 51 from the fixed contact 45 by the elastic force of its own. Further, the movable iron piece 19 is rotated via the pressing portion 36 of the card member 34. That is, the movable iron piece 19 rotates clockwise around the lower edge of the yoke 23 (cf. FIG. 8), and the horizontal portion 19*a* is held in the state of being separated from the suction surface of the iron core 20 of the electromagnet 18.

Figure 11:
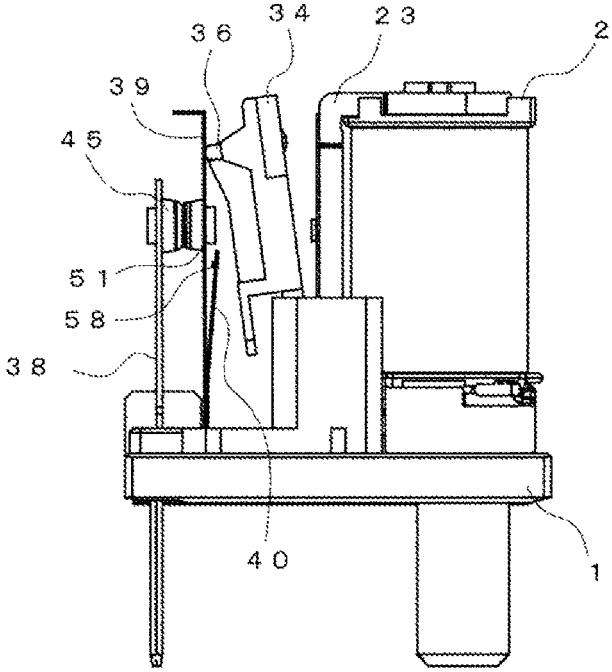
FIG. 11 is a front view showing a state immediately after closing of contacts where the electromagnet has been magnetized from the state of FIG. 10.
Figure 12:
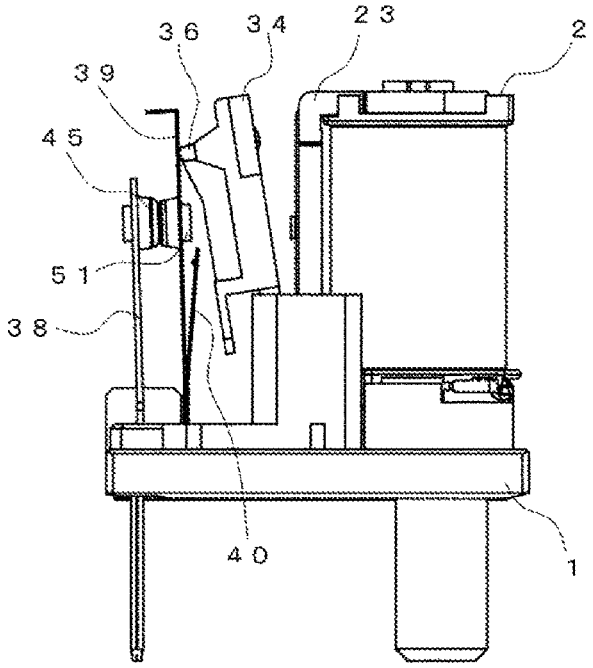
FIG. 12 is a front view in a state where a fixed contact is pressed onto by a movable contact from the state of FIG. 11.

When a voltage is applied to the coil 22 to magnetize the electromagnet 18, magnetic force acts from the suction surface of the iron core 20 on the horizontal portion 19*a* of the movable iron piece 19. Although the elastic force is acting from the movable touch piece 39 on the movable iron piece 19 via the pressing portion 36 of the card member 34, the energization force is acting from the auxiliary member 40 on the movable touch piece 39 so as to cancel this elastic force. Accordingly, in initial magnetization of the electromagnet 18, even in a state where the horizontal portion 19*a* of the movable iron piece 19 is most apart from the suction surface of the iron core 20 and the suction force cannot be sufficiently acted, the movable iron piece 19 can be rotated against the elastic force of the movable touch piece 39 as shown in FIGS. 10 to 12.

Figure 13:
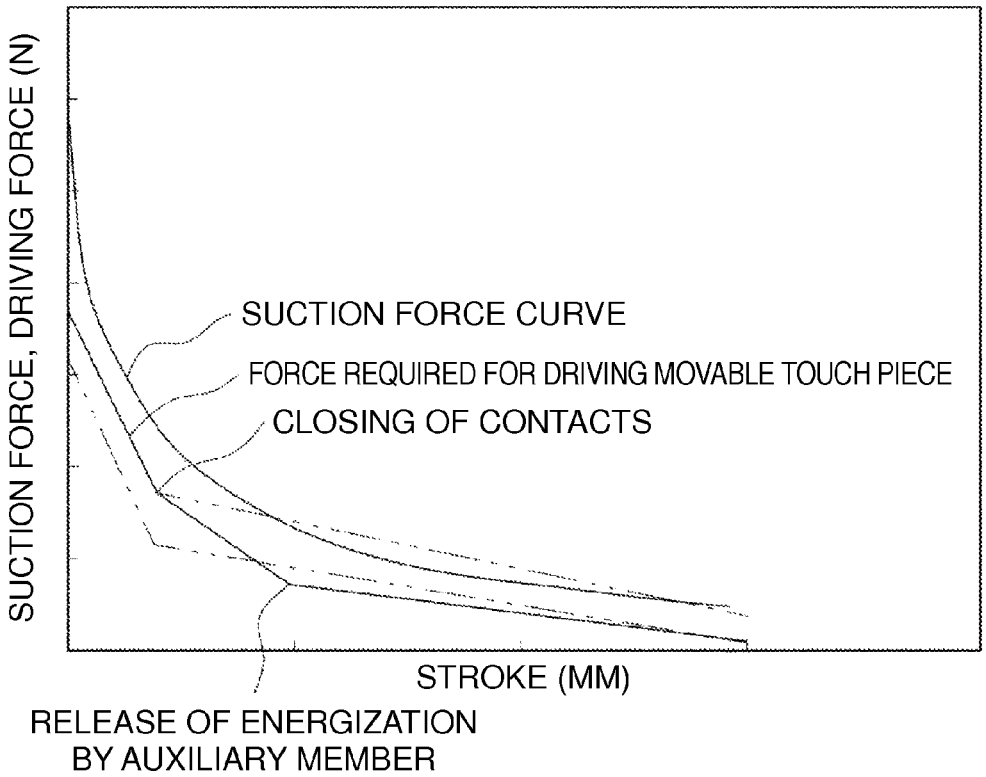
FIG. 13 is a graph showing the relation between a suction force curve and force (driving force) that acts on the movable touch piece.

Specifically, as shown in a graph of FIG. 13, with respect to a curve of suction force which can be acted on the movable iron piece 19 by the electromagnet 18, force (driving force) required for driving the movable touch piece 39 can be changed at two stages by providing the auxiliary member 40.

First, until the energization force generated by the auxiliary member 40 is released (initial driving period: in FIG. 10 before FIG. 11), force (driving force) required for elastically deforming the movable touch piece 39 gently changes as shown in a solid straight line (a) in FIG. 13. This is because the elastic force generated by the auxiliary member 40 is acting against the elastic force of the movable touch piece 39 so as to cancel this. Accordingly, it is possible to suppress the driving force to be small at the initial stage where the horizontal portion 19*a* of the movable iron piece 19 is apart from the suction surface of the iron core 20, sufficient suction force cannot be acted on the horizontal portion 19*a* of the movable iron piece 19 and the suction force curve gently changes. With the auxiliary member 40 being not fixed to the movable touch piece 39, the auxiliary member 40 makes the movable touch piece 39 change a sliding-contact position at the initial driving period. This can prevent occurrence of early damage and the like due to an increase in elastic force or stress concentration on a fixed place as in the case of those being fixed to each other.

Subsequently, when the movable touch piece 39 is driven and the energization force generated by the auxiliary member 40 ceases to act (intermediate driving period: FIG. 11), it becomes necessary to rotate the movable iron piece 19 against the elastic force of the movable touch piece 39, and the driving force thus increases. However, sufficient suction force can be acted due to the horizontal portion 19*a* of the movable iron piece 19 being close to the suction surface of the iron core 20. Hence it is possible to drive the movable touch piece 39 even when the energization force generated by the auxiliary member 40 is lost.

Thereafter, when the movable contact 51 moves onto the fixed contact 45 for closing, driving force for the elastic force of the fixed touch piece 38 in addition to the elastic force of the movable touch piece 39 becomes necessary. In this state, the horizontal portion 19*a* of the movable iron piece 19 comes close to the suction surface of the iron core 20, to allow sufficiently large suction force to be acted. Accordingly, the movable contact 51 is pressed onto the fixed contact 45, to allow desired contact pressure to be ensured (final driving period: from FIG. 11 till FIG. 12).

As thus described, according to the electromagnetic relay described above, providing the auxiliary member 40 enables suppression of force (driving force) required for driving the movable touch piece 39 at the stage where sufficient suction force cannot be acted in initial magnetization of the electromagnet 18. This allows smooth switch operations of the contacts.

Further, according to the electromagnetic relay described above, even when impact force acts due to accidental dropping or the like, a defect such as deformation is not apt to occur since the auxiliary member 40 is in press-contact with the movable touch piece 39.

It is to be noted that the present invention is not restricted to the configuration described above, but a variety of modifications can be made.

Figure 14:
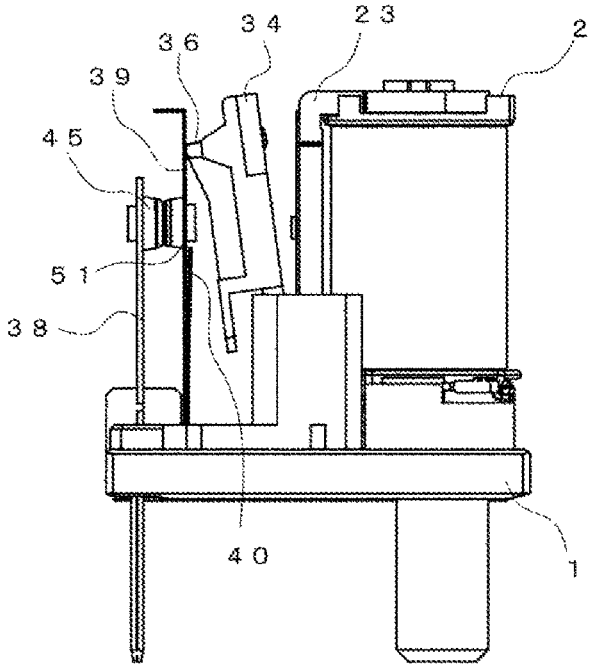
FIG. 14 is a front view of an electromagnetic relay according to one or more embodiments of the present invention, showing a state immediately after closing of the contacts where the electromagnet has been magnetized from the state of FIG. 10.
Figure 15:
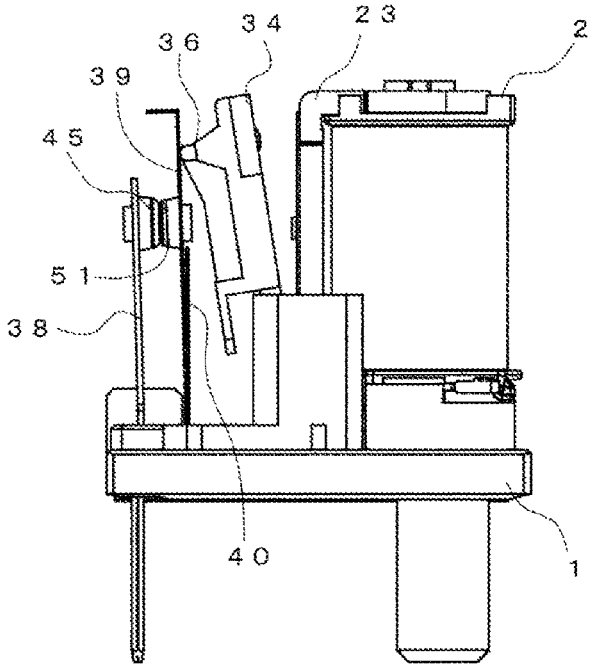
FIG. 15 is a front view in a state where the fixed contact has been pressed onto by the movable contact from the state of FIG. 14.

For example, although according to one or more of the above embodiments, the energization force generated by the auxiliary member 40 ceases to act on the movable touch piece 39 before the movable contact 51 moves onto the fixed contact 45 for closing as shown in FIGS. 10 to 12, according to one or more embodiments of the present invention, the auxiliary member 40 may be constantly in press-contact with the movable touch piece 39 as shown in FIGS. 14 and 15.

That is, in the demagnetized state of the electromagnet 18 shown in FIG. 10, a voltage is applied to the coil 22 to magnetize the electromagnet 18, and as shown in FIG. 14, the movable touch piece 39 is elastically deformed to move the movable contact 51 onto the fixed contact 45 for closing. During this operation, the auxiliary member 40 energizes the movable touch piece 39, to support elastic deformation of the movable touch piece 39. Then as shown in FIG. 15, a configuration is formed such that at the stage of the movable contact 51 pressing onto the fixed contact 45 after closing of the contacts, the state of pressing by the auxiliary member 40 is released and the movable touch piece 39 is no longer pressed.

Figure 16:
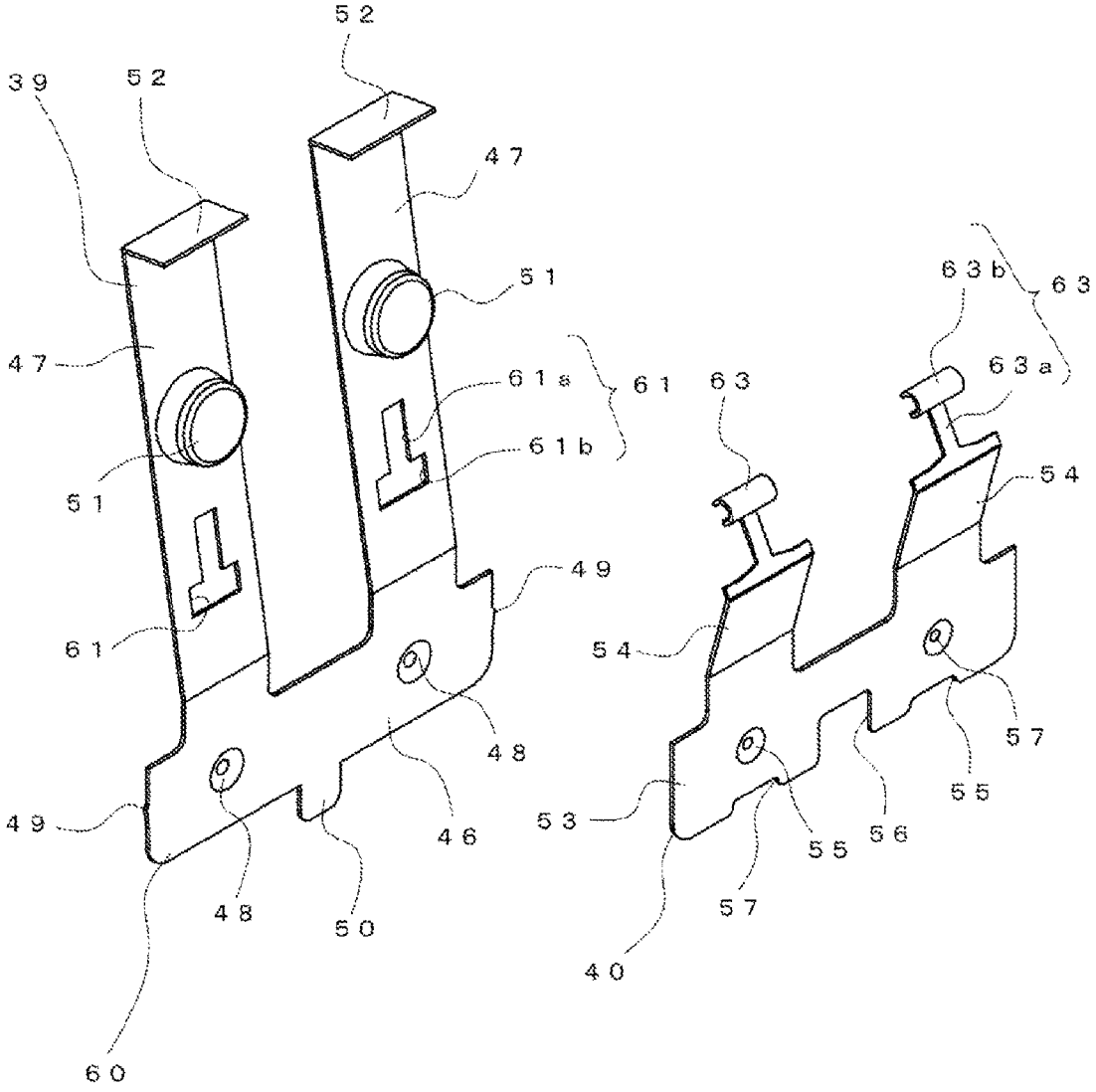
FIG. 16 is a perspective view of a movable touch piece and an auxiliary member according to one or more embodiments of the present invention.

Further, although the one surface (the surface on the opposite side to the fixed touch piece 38) of the movable touch piece 39 is pressed by the auxiliary member 40 in one or more of the above embodiments, a configuration may be formed such that it is pulled from the fixed touch piece 38 side as shown in FIG. 16. It is to be noted that in the following description, the same configurations as those of the movable touch piece 39 and the auxiliary member 40 shown in FIG. 7 will be provided with the corresponding numerals, and descriptions thereof will be omitted.

That is, a guide hole 61 is formed in a part below the movable contact 51 in the body portion 47 of a movable touch piece 60. The guide hole 61 is made up of a slit portion 61*a* along a central line of the body portion 47 and a wide portion 61*b* continued from the lower end of the slit portion 61*a*. On the other hand, a guide protrusion portion 63 guided from the central portion at the upper end of each energizing portion 54 to the guide hole 61 protrudes in an auxiliary member 62. The guide protrusion portion 63 is made up of a connection portion 63*a* having a smaller width than the slit portion 61*a*, and a latching portion 63*b* provided at the leading end of the connection portion 63*a*. The latching portion 63*b* is insertable into the wide portion 61*b*, and formed wider than the slit portion 61*a*.

The auxiliary member 62 is arranged such that the press-fitting portions 46, 53 come into surface-contact with each other on the fixed touch piece 38 side with respect to the movable touch piece 60. Then, the guide protrusion portion 63 of the auxiliary member 62 is inserted into the guide hole 61 of the movable touch piece 60, and the connection portion 63*a* is located in the slit portion 61*a* while the latching portion 63*b* is located on the opposite surface to the movable touch piece 60 (surface on the opposite side to the fixed touch piece 38). In this state, the latching portion 63*b* of the auxiliary member 62 is in press-contact with the movable touch piece 60, and energization force thereof is acting so as to cancel part of the elastic force of the movable touch piece 60.

Figure 17:
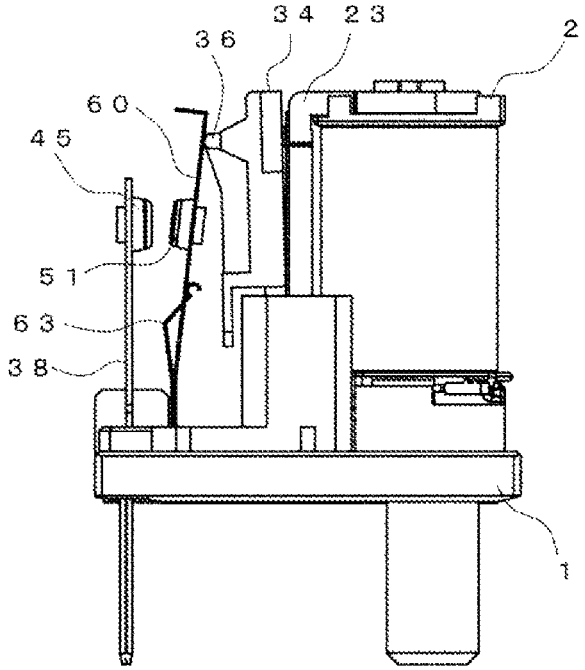
FIG. 17 is a front view of an electromagnetic relay provided with the movable touch piece and the auxiliary member shown in FIG. 16, from which the casing has been removed, with the electromagnet being in a non-magnetized state.
Figure 18:
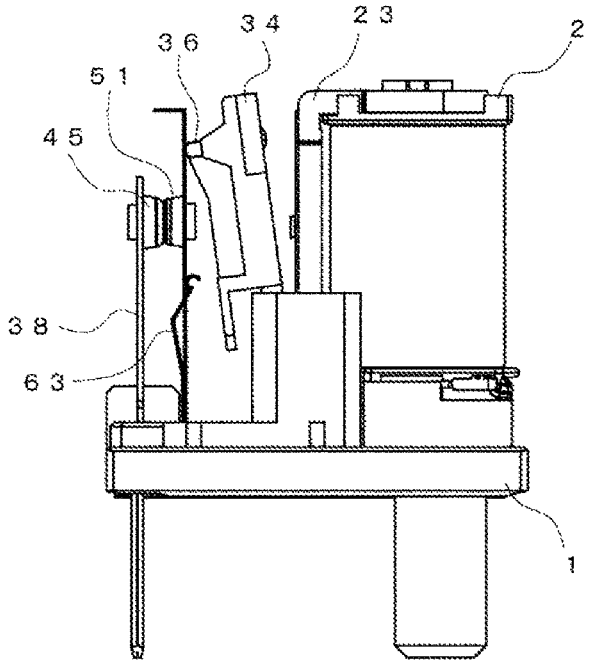
FIG. 18 is a front view showing a state before closing of the contacts where the electromagnet has been magnetized from the state of FIG. 17.
Figure 19:
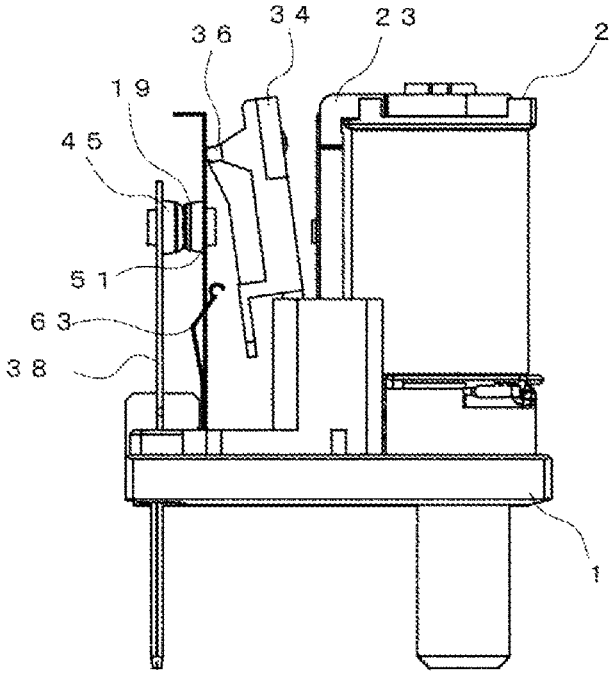
FIG. 19 is a front view showing a state immediately after closing of the contacts where the movable touch piece has been driven from the state of FIG. 18.
Figure 20:
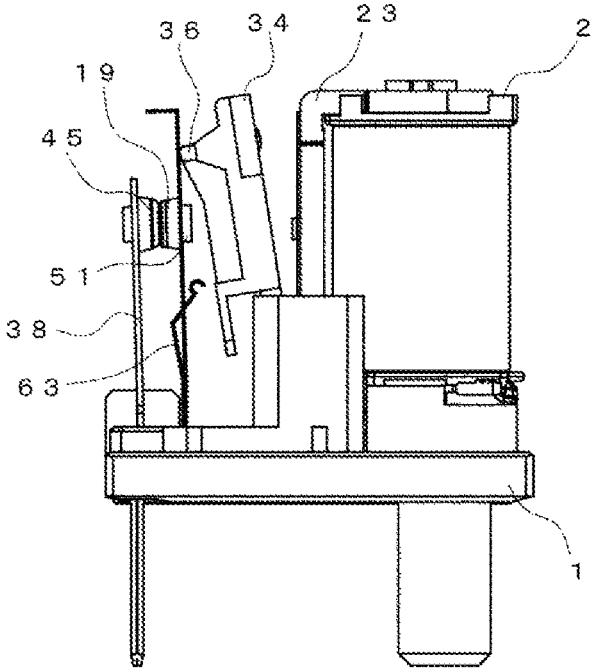
FIG. 20 is a front view in a state where the fixed contact has been pressed onto by the movable contact from the state of FIG. 19.

According to the electromagnetic relay provided with the movable touch piece 60 and the auxiliary member 62 having the above configuration, in a state where the electromagnet 18 not applying a voltage to the coil 22 is not magnetized, the contacts are held in an open state by the elastic force of the movable touch piece 60, as shown in FIG. 17. At this time, energization force is acting on the movable touch piece 60 so as to cancel the elastic force of the auxiliary member 62 as described above. Therefore, it is possible to alleviate driving force required at the initial stage where the electromagnet 18 is magnetized to rotate the movable iron piece 19. When the state shifts from immediately before closing of the contacts shown in FIG. 18 to closing of the contacts shown in FIG. 19, the energization force generated by the auxiliary member 62 ceases to act on the movable touch piece 60. Subsequently, as shown in FIG. 20, the movable contact 51 is pressed onto the fixed contact 45, to obtain a closed state with desired contact pressure.

Moreover, although the movable touch piece 60 and the auxiliary member 62 come into surface-contact with each other only in the press-fitting portion 46 in one or more of the above embodiments, those are preferably brought into surface-contact at least in a successive part between respective movable contacts 51 (the body portion 47 and the press-fitting portion 46). According to this, the conduction part between the movable contacts 51 can be made up of the auxiliary member 40 as well as the movable touch piece 39. That is, it is possible to increase a sectional area in the conduction part, so as to form a configuration with excellent current supply characteristics.

Figure 21A:
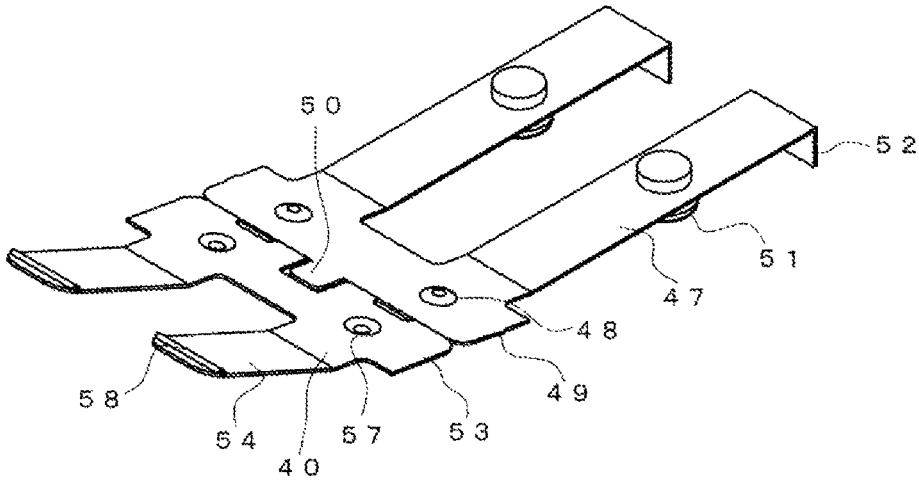
FIG. 21A is a perspective view showing a state before bending of the movable touch piece and the auxiliary member which are integrally formed according to one or more embodiments of the present invention.
Figure 21B:
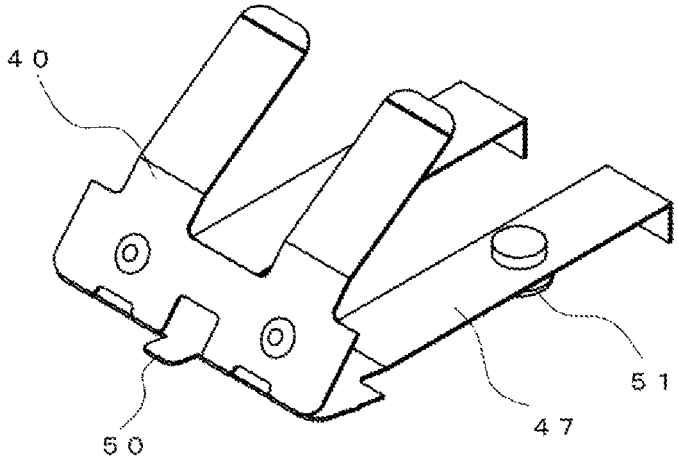
FIG. 21B is a perspective view showing a state after the bending.

Furthermore, although the auxiliary member 40 and the movable touch piece 39(60) have been configured of different members in one or more of the above embodiments, those may be integrally configured as shown in FIG. 21. That is, the lower edge of the movable touch piece 39 is rotatably connected with the auxiliary member 40. Specifically, as shown in FIG. 21A, the lower edge of the movable touch piece 39 is bendably connected with one edge of the auxiliary member 40, except for a part to become the press-fitting piece 50 in the central portion and the slits formed in two places on both sides thereof. As shown in FIG. 21B, a part to become the auxiliary member 40 is flexed in the middle, and the leading end portion thereof can come into contact with the movable touch piece 39 by being bent in the bent part.

According to this configuration, the auxiliary member 40 and the movable touch piece 39 can be integrally processed by pressing and need not be separately managed, thus making subsequent handling thereof convenient. Then, the auxiliary member 40 can be made to exert a desired function just by being bent and press-fitted into the base 1, and hence assembly processing properties are also excellent.

Additionally, although the movable touch piece 39(60) has been configured such that the pair of movable contacts 51 are conducted and the pair of fixed touch pieces are closed in one or more of the above embodiments, this is not restrictive, but may be configured such that the movable touch piece 39 and the fixed touch piece 38 are regarded as one pair and then two or more pairs of contact switch parts are provided. In short, it is possible to obtain the above effect in the electromagnetic relay by providing the auxiliary member 40 regardless of the difference in shape thereof so long as the electromagnetic relay is configured to drive the movable touch piece 39.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electromagnetic relay, comprising:

a fixed touch piece comprising a fixed contact;

a movable touch piece, comprising a movable contact contactably and separably opposed to the fixed contact, and configured to elastically deform;

an auxiliary member configured to energize the movable touch piece to the fixed contact piece side;

an electromagnet; and an intermediate member configured to be operated by magnetization of the electromagnet and elastically deform the movable touch piece, wherein the auxiliary member comes into surface-contact from a terminal portion of the movable touch piece to a vicinity of the movable contact.

2. The electromagnetic relay according to claim 1, wherein the auxiliary member energizes the movable touch piece from the surface on the opposite side to the fixed touch piece.

3. The electromagnetic relay according to claim 1, wherein the auxiliary member is configured to energize the movable touch piece to the fixed touch piece side up to a predetermined position before closing of the contacts.

4. The electromagnetic relay according to claim 1, wherein the auxiliary member is configured so as to no longer energize the movable touch piece after closing of the contacts.

5. The electromagnetic relay according to claim 2, wherein the auxiliary member is configured so as to no longer energize the movable touch piece after closing of the contacts.

6. The electromagnetic relay according to claim 3, wherein the auxiliary member is configured so as to no longer energize the movable touch piece after closing of the contacts.

* * * * *